United States Patent [19]

Punchak

[11] Patent Number: 4,508,250

[45] Date of Patent: Apr. 2, 1985

[54] AMPOULE BREAKER TOOL

[76] Inventor: Kathleen Punchak, 13512 Mohawk Trail, Middleburg Hts., Ohio 44130

[21] Appl. No.: 483,763

[22] Filed: Apr. 11, 1983

[51] Int. Cl.[3] ..... G26F 3/00

[52] U.S. Cl. ..... 225/97; 225/93

[58] Field of Search ..... 225/93, 97; 241/99

[56] References Cited

U.S. PATENT DOCUMENTS

| | | | |
|---|---|---|---|
| 2,515,020 | 7/1950 | Scott | 241/99 |
| 3,380,636 | 4/1968 | Ushkow et al. | 241/99 |
| 3,450,319 | 6/1969 | Ray et al. | 241/99 |
| 3,796,359 | 3/1974 | Dick | 225/93 |
| 4,226,376 | 10/1980 | Pfleger | 225/93 |
| 4,417,679 | 11/1983 | Shields | 225/93 |

*Primary Examiner*—E. R. Kazenske
*Assistant Examiner*—Hien H. Phan
*Attorney, Agent, or Firm*—J. Helen Slough

[57] ABSTRACT

An ampoule breaker tool comprising a lever containing a plurality of through-holes and adapted to engage the upper bulb portion of an ampoule provides an efficient and safe means for opening ampoules. The tool can be hand held whereby leverage is provided remote from the ampoule bulb to transmit a force on the mid-section of the ampoule bulb and sever the bulb from the ampoule.

9 Claims, 13 Drawing Figures

AMPOULE BREAKER TOOL

This invention pertains to a safety device for opening ampoules and more particularly to a mechanical leverage tool adapted to sever the sealed upper portion of the ampoule to gain access to the liquid contents of the ampoule.

Ampoules are small glass vials used primarily for containing pharmaceuticals and particularly useful for injection purposes. A typical ampoule comprises a cylindrical lower body portion for containing the liquid, an upper tapered bulb portion, and a narrow restricted neck interconnecting the lower body portion to upper bulb portion. The uppermost tip of the bulb is flame sealed after the ampoule is filled with a pharmaceutical liquid to insure sterility of the ampoule contents. In use, the ampoule is opened by severing the upper bulb from the lower body of the ampoule at the interconnecting narrowed neck. However, the ampoule is customarily hand held by the operator such as a nurse and frequently injuries are sustained due to shattering of the ampoule bulb in the nurse's hand.

Various cutting devices have been suggested for cutting or filing the ampoule neck. More recently, a hand-held finger cap for covering the bulb portion of the ampoule while snapping the neck has been disclosed in U.S. Pat. Nos. 3,544,020, 3,862,654 and 3,720,250.

It now has been found that ampoules can be efficiently and safely opened without fear of injury and without contamination of the contents by use of an ampoule breaking tool comprising an elongated lever having a through-hole, or a plurality of through-holes at the leverage end of the tool and adapted to engage the upper bulb portion and to sever the bulb from the ampoule at the narrowed neck. Preferably the through-holes in the ampoule breaker includes impinging resilient elastomeric cushioning material for securely engaging the upper portion of the bulb while a leverage force is applied to the ampoule to cleanly sever the ampoule at the narrowed neck. Accordingly, the operator can grasp the tool a distance remote from the ampoule bulb whereby considerable leverage can be applied to the ampoule bulb without the need for directly grasping the bulb portion of the ampoule. Injuries and contamination are avoided by not directly gripping the ampoule bulb while the ampoule bulb can be easily severed without much leverage effort. These and other advantages of this invention will become more apparent by referring to the drawings and detailed description of the invention.

Briefly, the invention pertains to a hand held ampoule breaker tool comprising an elongated lever adapted to provide leverage force to the mid-section of the ampoule bulb to sever the bulb from the ampoule. The leverage end of the tool contains a through-hole or a plurality of through-holes adapted to engage the mid-section of the bulb above the neck, whereby a leverage force can be applied thereto and provide a clean break at the narrowed neck. The plurality of through-holes vary in diameter to accomodate different size ampoules. The gripping end of the tool enables the operator to apply leverage force remote from the ampoule bulb.

Figure 1:
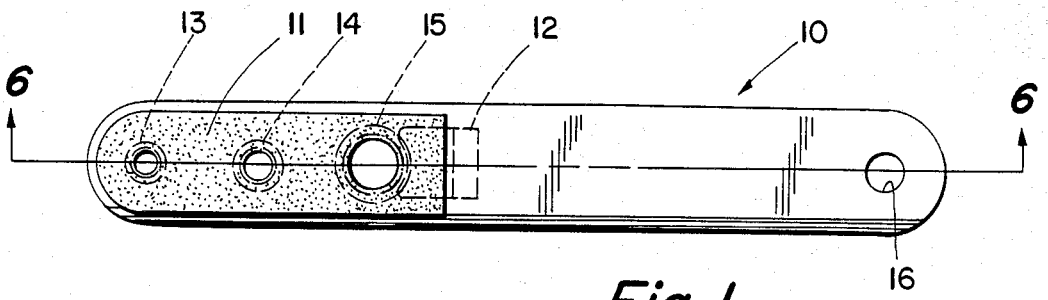
FIG. 1 is a top plan view of the ampoule breaker tool of this invention.

Referring now to the drawings wherein like reference characters designate like parts, shown generally is an ampoule breaker hand tool 10 comprising a flat lever of hard rigid material such as metal or rigid plastic and particularly useful to sever the top bulb portion of various size ampoules.

The tool 10 comprises a leverage end preferably containing a plurality of through-holes 13, 14, 15 and a hand gripping end containing a single hook hole 16 for hanging the tool 10 on a hook for storage purposes. The plurality of through-holes 13, 14, 15 vary in cross-section size increasing in diameter to accomodate variable size ampoules. Each through-hole 13, 14, 15 is defined by slightly tapered internal walls having a slightly larger bottom diameter opening relative to the top diameter to provide a frustum shaped through-hole. The frustum shaped through-holes 13, 14, 15 are particularly adapted to engage the mid-section of the upper bulb portion of the ampoule, as viewed in FIG. 2.

Figure 6:
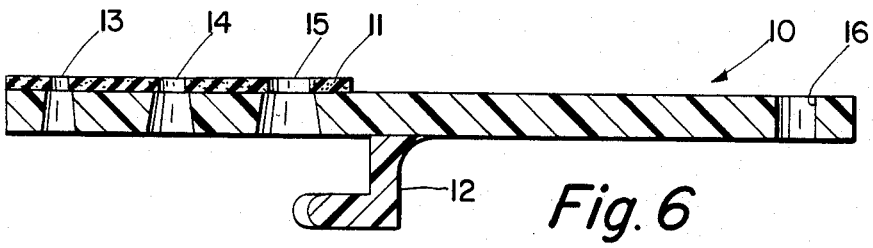
FIG. 6 is an elevation sectional view taken along lines 6—6 in FIG. 1.
Figure 4:
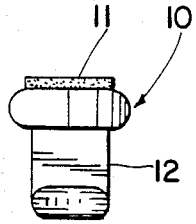
FIG. 4 is a side elevation view as viewed from the left in FIG. 2.
Figure 5:
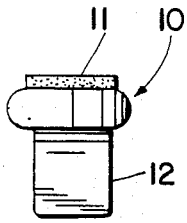
FIG. 5 is a side elevation view as viewed from the right in FIG. 2.
Figure 7:
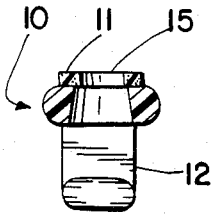
FIG. 7 is an elevation sectional view taken along lines 7—7 in FIG. 2.

The ampoule breaker hand tool 10 further contains a resilient elastomeric cushioning means such as elastomeric strip 11 adhered or otherwise secured to the upper surface of the leverage portion of tool 10 proximate to the through-holes 13, 14, 15. The elastomeric means can be elastomeric rubber or elastomeric polymer such as polyurethane. As best viewed in FIG. 6, the elastomeric cushioning material 11 contains holes aligned and communicating with through-holes 13, 14, 15, but having slightly smaller diameter openings and slightly overlapping the circumferential periphery of each through-hole 13, 14, 15. The protruding elastomeric material 11 is adapted to impinge upon and grip the upper portion of the ampoule while the frustum shaped internal walls of the through-hole 13, 14, 15 engage the mid-section of the upwardly extending ampoule bulb. The tapered frustum walls provide a seating or engaging means for steady securement of the ampoule bulb while using the tool 10.

Figure 2:
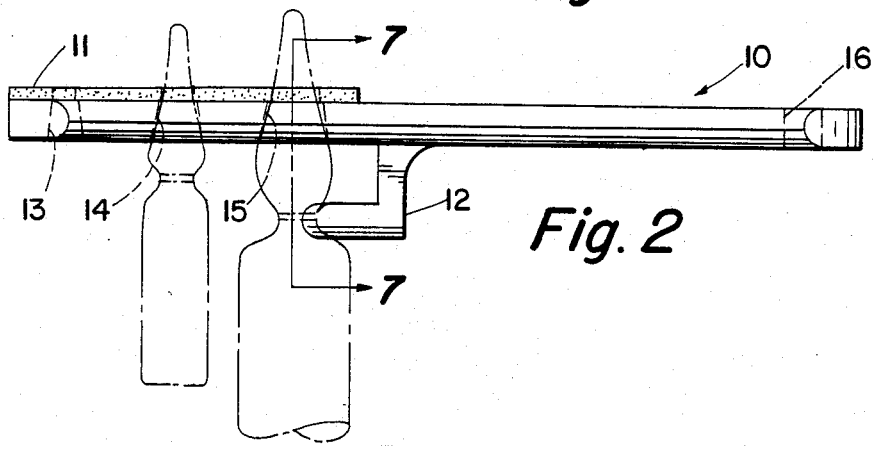
FIG. 2 is a front elevation view of the tool in FIG. 1 illustrating use of the tool with ampoules shown in phantom lines.
Figure 3:
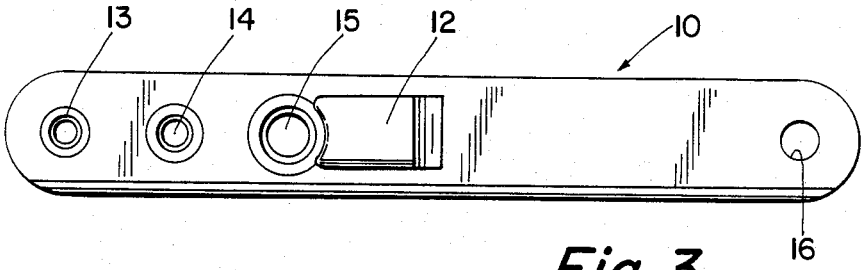
FIG. 3 is a bottom view of the tool shown in FIG. 1.

The largest through-hole 15 is adapted to engage large size ampoules and, as best viewed in FIG. 2, the tool 10 includes a downwardly depending rigid foot member 12 having a laterally disposed pressing arm adapated to engage or embrace the neck portion of a large ampoule disposed within the largest through-hole 15. As viewed in FIG. 3, the distal end of the laterally directed pressing arm preferably includes a concave surface particularly aligned to engage a portion of the outer circumference of the ampoule narrowed neck. The foot member 12 can be secured to the under surface of the tool 10. Accordingly, pressure applied to the narrowed neck in conjunction with the force applied by the frustum walls engaging the mid-section of the ampoule bulb easily severs the bulb from large ampoules at the narrowed neck with leverage applied at the hand grip end of the tool 10.

Figure 8:
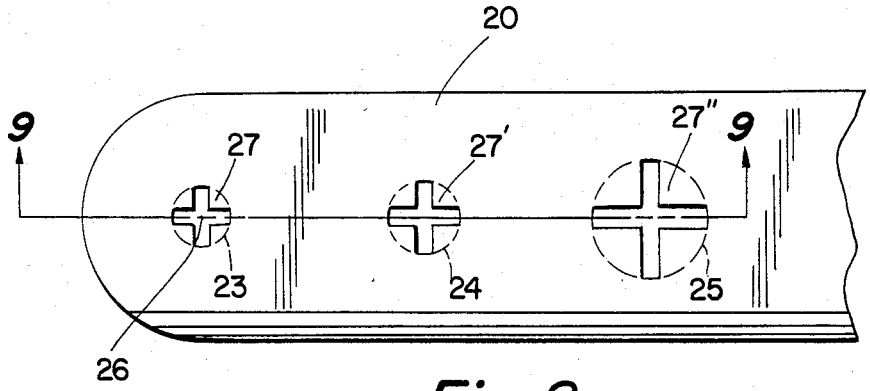
FIG. 8 is an enlarged partial plan view of the leverage end of a further embodiment of the ampoule breaker tool.
Figure 9:
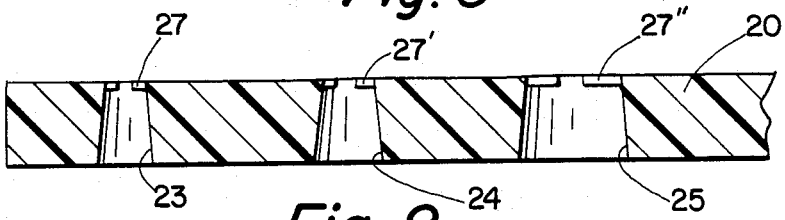
FIG. 9 is an elevation sectional view taken along lines 9—9 in FIG. 8.
Figure 10:
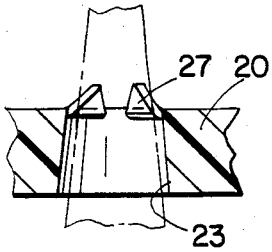
FIG. 10 is an enlarged partial view of one of the through-holes in FIG. 9 and showing a portion of an ampoule bulb in phantom lines.

Referring now to FIGS. 8–10 inclusive, a further embodiment of this invention is shown wherein the leverage end of the ampoule breaker tool 20 contains variable cross-sectional size through-holes 23, 24, 25 and includes elastomeric cushioning means 27, 27′, 27″ slightly overlapping through-holes 23, 24, 25 at the upper surface. The elastomeric cushioning means is illustrated as quadrant tips adapted to resiliently impinge upon an ampoule bulb. The quadrant elastomeric materials 27, 27′, 27″ are adhered or otherwise secured to the circumferential peripheral surface of each respective through-hole 23, 24, 25 adjacent to the upper surface of the tool 20. Accordingly, the elastomeric quadrant tip members resiliently engage or impinge upon the mid-section of the ampoule bulb as indicated by phantom lines in FIG. 10.

Figure 13:
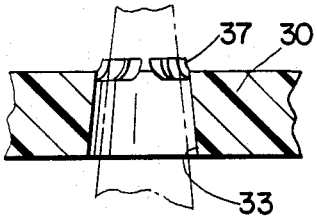
FIG. 13 is an enlarged partial view of one of the through-holes in FIG. 12 showing a portion of an ampoule bulb in phantom lines.
Figure 11:
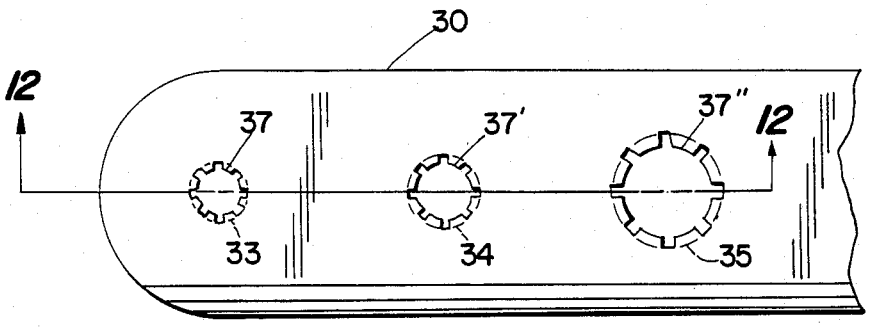
FIG. 11 is an enlarged partial plan view of the leverage end of a further embodiment of the ampoule breaker tool.
Figure 12:
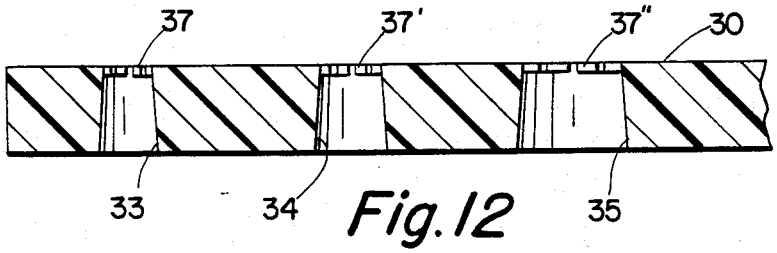
FIG. 12 is an elevation sectional view taken along lines 12—12 in FIG. 11.

In similar manner, FIGS. 11–13 inclusive illustrate still a further embodiment wherein the leverage portion of an ampoule breaker tool 30 contains through-holes 33, 34, 35 equipped with elastomeric cushioning means 37, 37′, 37″ comprising a plurality of circumferentially spaced blunt nibs adapted to resiliently impinge upon the upper bulb of an ampoule. The blunt nibs are secured to the upper periphery of each through-hole 33, 34, 35 adjacent to the upper surface of the tool 30, whereby the blunt nibs are directed radially inwardly to impinge upon or otherwise engage the ampoule bulb as shown in FIG. 13. In both the embodiments shown in FIGS. 8–10 or FIGS. 11–13, the largest through-hole 25 or 35 can be used in conjunction with a downwardly depending foot member 12 having a laterally disposed pressing arm containing a concave surface adapted to engage the rounded neck of large ampoules, whereby the pressing arm in conjunction with leverage applied force to the mid-section of the bulb easily and cleanly severs the upper bulb at the narrowed neck portion of large ampoules, as previously described with respect to FIGS. 2 and 3.

In use, the ampoule breaker tool can be utilized by an operator by placing the bulb portion of an ampoule within one of the frustum shaped through-holes particularly suitable for the size ampoule to be opened. The frustum wall members engage the mid-section of the upper bulb of the ampoule while the elastomeric cushioning means resiliently engages the upper tip of the ampoule bulb in a set position as best viewed in FIG. 2. The operator's left hand can safely grip the cylindrical body portion of the ampoule while the right hand can safely grip the remote handgrip end of the tool. Alternatively, the hand gripping end of the tool can be secured permanently to a wall for instance instead of hand holding the tool. The operator can impart a twisting or torque leverage on the tool whereby the leverage end of the tool applies leverage force to the mid-section of the ampoule bulb thereby causing the ampoule bulb to cleanly sever at the narrowed neck of the ampoule. In a similar manner, large ampoules can be opened by inserting the bulb portion of the large ampoule into through-hole 15 for instance and engaging the frustum shaped walls thereof. The narrowed neck of the large ampoule further engages the concave surface of the lateral pressing arm of foot member 12 as best viewed in FIGS. 2 and 3. Accordingly, the operator can apply leverage force to the mid-section of the bulb in conjunction with laterally applied pressure to the narrowed neck whereby large ampoules can be cleanly severed without injury to the operator.

The ampoule breaker tool of this invention provides a safe means for severing the upper bulb from an ampoule by remotely applied leverage force to the mid-section of the bulb whereby the operator's hands are safely remote from the breaking bulb portion. The foregoing description is not intended to limit the scope of the invention except by the appended claims.

What I claim is:

1. An ampoule breaking tool for opening an ampoule having a lower body, an upper bulb portion with an uppermost sealed tip, and a restricted narrowed neck portion interposed between the lower body and the upper bulb, the tool comprising:

an elongated rigid lever having a leverage end and a remote gripping end, the leverage end including at least one through-hole having a frustrum shaped inner wall adapted to engage the mid-section of the bulb portion of the ampoule above the narrowed neck, at least one of the through-holes being a large through-hole to accomodate a large ampoule, and said tool having secured thereto a depending member having a laterally directed pressing arm adapted to engage the neck portion of the large ampoule secured within the large through-hole, whereby manual leverage force applied to the mid-section of the ampoule bulb severs the bulb from the ampoule, the leverage end of the tool contains a plurality of variable size through-holes adapted to engage variable size ampoules.

2. The tool in claim 1 wherein the pressure arm has a convex pressure surface to engage the narrowed neck of the ampoule.

3. An ampoule breaking tool for opening an ampoule having a lower body, an upper bulb portion with an uppermost sealed tip, and a restricted narrowed neck portion interposed between the lower body and the upper bulb, the tool comprising:

an elongated rigid lever having a leverage end and a remote gripping end, the leverage end including at least one through-hole having a frustrum shaped inner wall adapted to engage the mid-section of the bulb portion of the ampoule above the narrowed neck, wherein the lever provides an upper periphery surrounding each through-hole and includes elastomeric cushioning means secured proximate to the upper periphery of each frustrum shaped through-hole to provide resilient engagement of the upper portion of the ampoule bulb, whereby manual leverage force applied to the mid-section of the ampoule bulb severs the bulb from the ampoule.

4. The tool in claim 3 wherein the elastomeric means comprises resilient rubber.

5. The tool in claim 3 wherein the elastomeric means comprises resilient elastomeric polymer.

6. The tool in claim 3 wherein the elastomeric cushioning member comprises an elastomeric strip secured to the upper periphery surrounding each through-hole of the tool wherein the elastomeric strip contains an opening communicating with each through-hole wherein the elastomeric opening provides restrictive impingement to the upper portion of the ampoule bulb.

7. The tool in claim 3 wherein the elastomeric cushioning means comprises a plurality of inwardly directed impinging members secured to the upper periphery of each through-hole, wherein the impinging members are directed radially inward and adapted to resiliently impinge upon the ampoule bulb.

8. The tool in claim 7 wherein the plurality of impinging members comprise radially separate quadrant tips.

9. The tool in claim 7 wherein the plurality of impinging members comprise a plurality of radially separated blunt nibs.

* * * * *